United States Patent [19]

Jordan

[11] 4,311,113

[45] Jan. 19, 1982

[54] METHOD AND APPARATUS FOR DEPOSITING FLOCK FIBERS

[75] Inventor: Richard A. Jordan, Lexington, Ky.

[73] Assignee: Solar Suede Corporation, Lexington, Ky.

[21] Appl. No.: 150,741

[22] Filed: May 19, 1980

Related U.S. Application Data

[60] Division of Ser. No. 872,671, Jan. 26, 1978, Pat. No. 4,246,294, which is a continuation-in-part of Ser. No. 673,439, Apr. 5, 1976, abandoned.

[51] Int. Cl.[3] ..... B05B 5/02

[52] U.S. Cl. ..... 118/629; 118/308; 118/640

[58] Field of Search ..... 118/308, 621, 629, 640; 427/27

[56] References Cited

U.S. PATENT DOCUMENTS

| | | | |
|---|---|---|---|
| 2,173,032 | 9/1939 | Wintermute | 427/32 |
| 2,221,338 | 11/1940 | Wintermute | 427/206 |
| 2,497,696 | 2/1950 | Smith | 427/27 |
| 2,527,501 | 10/1950 | Saks | 427/27 |
| 2,806,803 | 9/1957 | Thackara et al. | 427/27 |
| 2,889,083 | 6/1959 | Schwinhorst | 118/308 |
| 3,347,469 | 10/1967 | Ross et al. | 239/424 |
| 3,436,442 | 4/1969 | Saks | 427/32 |
| 3,504,861 | 4/1970 | Peeps et al. | 239/8 |
| 3,551,178 | 12/1970 | Chimelar | 427/27 |
| 3,740,260 | 6/1973 | Winn | 237/8 |
| 3,777,874 | 12/1973 | Birckhead | 118/308 |
| 3,889,636 | 6/1975 | Smith | 118/627 |
| 3,999,508 | 12/1976 | De Rop et al. | 118/308 |
| 4,092,737 | 5/1978 | Sandell | 366/3 |

*Primary Examiner*—John H. Newsome

*Attorney, Agent, or Firm*—Jenkins, Coffey, Hyland, Badger & Conard

[57] ABSTRACT

A method and apparatus for depositing flock wherein flock fibers are fed at a controlled rate from a storage hopper through a screen into a propelling air stream. The air stream carries the fibers in a rotationally stabilized flow to an applicator gun where they may be electrostatically charged, and they are propelled by the air stream and deposited on the adhesively coated surface to be coated.

5 Claims, 5 Drawing Figures

METHOD AND APPARATUS FOR DEPOSITING FLOCK FIBERS

This is a division of application Ser. No. 872,671 filed Jan. 26, 1978 now U.S. Pat. No. 4,246,294 which was a continuation-in-part of my copending application Ser. No. 673,439, filed Apr. 5, 1976 now abandoned.

This invention relates to coating methods and apparatus, and more specifically, to an improved method and apparatus for electrostatically applying to an adhesively coated surface a coating of highly conductive flock fibers, that is, particles having a length greater than 0.010 inch and an electrical resistance of from about $5\times10^5$ to about $1\times10^{11}$ ohms. These particles are contrasted with dry powder particles for use in electrostatic coating having a length less than about 0.010 inch and an electrical resistance of greater than about $1\times10^{12}$ ohms.

A variety of electrostatic coating apparatus and methods are known for applying paint, powders, or flock fibers to a wall or other surface being coated. Typically, electrostatic coating processes may comprise supplying the desired coating material to a hand held applicator gun which has a highly charged electrode or electrodes for electrostatically charging the coating material by setting up an electrostatic field between the gun and the surface of the article being coated. The article is normally grounded so that the oppositely charged coating material is drawn thereto thereby making the coating process fast and highly efficient with little waste or over spray. The electrostatic field also causes the charged coating material to surround the grounded article, and thereby enable simultaneous coating of remote sides of said article. Of course, with liquid paint, the coating material easily sticks to the article. However, with coating materials such as flock fibers, it is necessary to cover the article with an adhesive prior to electrostatic deposition of the flock so that the coating material will adhere to said article.

A major problem in the electrostatic coating industry arises in the supplying of dry, non-liquid coating materials to the applicator gun at a carefully controlled rate. That is, paint in liquid form can be pumped easily through supply tubing to an applicator gun at a controlled rate, but powders and flock fibers require special handling. Accordingly, with powders, it has been common practice to entrain the dry powder particles in a moving air stream by means of a so-called fluidic bed. In such a bed, the particles are spread in a thin layer over a flat surface having a plurality of fine air streams passing upwardly therethrough. This creates a particle cloud above the flat surface, and this cloud is picked up by another moving air stream for transporting to an applicator gun.

Fluidic beds have not been at all satisfactory when used with flock fibers because the fibers undesirably tend to clump or tangle together on the bed and have a greater bulk factor than powders. Another problem encountered in electrostatic flocking processes employing applicator guns is that once flock fibers have been entrained in an air stream, it has been felt to be necessary to separate the fibers from the air stream as they exit the applicator gun. This insures that the flock fibers are propelled toward the article being coated almost solely by the effects of the electrostatic field to obtain a flock coating. That is, the gun is provided with a series of baffles to remove the flock fibers from the transporting air stream once said fibers are charged. This prevents the fibers from being propelled at a high rate of speed toward the article being coated, and prevents the non-embedded fibers from bouncing off the article. Failing to use the propelling action of the transporting air stream limits the distance which the fibers can be projected from the gun. It also limits the directional control of the fibers to the articles to be coated. And it fails to remove excess fibers that are not captured by the adhesive film on the article being coated. These factors limit the utility of the gun for coating the remote sides of the article, as well as interior surfaces and cavities, and fail to insure a uniform flock coating on the article.

Some attempts have been made to provide better control over the supplying of flock fibers to an applicator gun. See, for example, U.S. Pat. No. 3,551,178, wherein flock fibers fall through a screen and further through adjustable-size openings for entrainment in a transporting air stream. The air stream carries the entrained fibers to an applicator gun where, according to conventional practice, the fibers are separated by baffles from the transporting stream. Thus, the fiber deposition feed rate, the directional control of the charged fibers, and the distance to which the fibers can be projected are all limited.

This process of separating the charged fibers from the transporting air stream thus has the same attendant disadvantages as the conventional electrostatic flocking process in which excessive quantities of the fibers are dropped from a storage hopper and fall by gravity toward the grounded articles to be coated while said articles are moved between a pair of electrically charged grids. The grids create an ionizing zone through which the fibers fall. A portion of the fibers become electrically charged in the ionizing zone and are thus attracted to the grounded articles. However, the greatest percentage of the fibers fall through the ionizing zone and are not deposited on the articles and/or are loosely physically held as non-adhesively bound fibers in the other fibers which are bound by the adhesive coating.

The electrostatic flocking method of this invention overcomes the problems and deficiencies of the prior art by providing a controllable method of supplying flock fibers and a transporting air stream in a rotationally stabilized flow while at the same time allowing the transporting stream to help direct the charged flock fibers toward the surface of the article being coated and remove the non-adhesively bound fibers from the article.

In accordance with one form of carrying out my invention, I employ an apparatus in which the fibers to be deposited are stored in a hopper having a screen across the bottom thereof. A brush is spaced slightly above the screen and is controllably rotated to cause the flock fibers to fall through the screen at a controlled rate. The fibers fall into a trough having a vibrator thereon which axially aligns the fibers and feeds them into the mouth of a venturi flow tube where they are picked up by a propelling air stream. The propelling stream carries the flock fibers in a rotationally stabilized flow to and through an applicator gun having a plurality of highly charged electrodes carried in a nozzle at the exit end thereof for electrostatically charging said fibers.

The electrostatically charged fibers are projected from the gun nozzle toward the adhesively coated grounded article by the aforesaid propelling air stream.

The fibers are deposited in the adhesive film on the article, but the fibers which are not bound into said film are blown away by the air stream and are either exhausted away from the article or are reswirled in the ionizing zone between the gun and article so they will be again attracted to and bound to the adhesive film on the article.

The accompanying drawings illustrate the invention. In such drawings.

Figure 1:
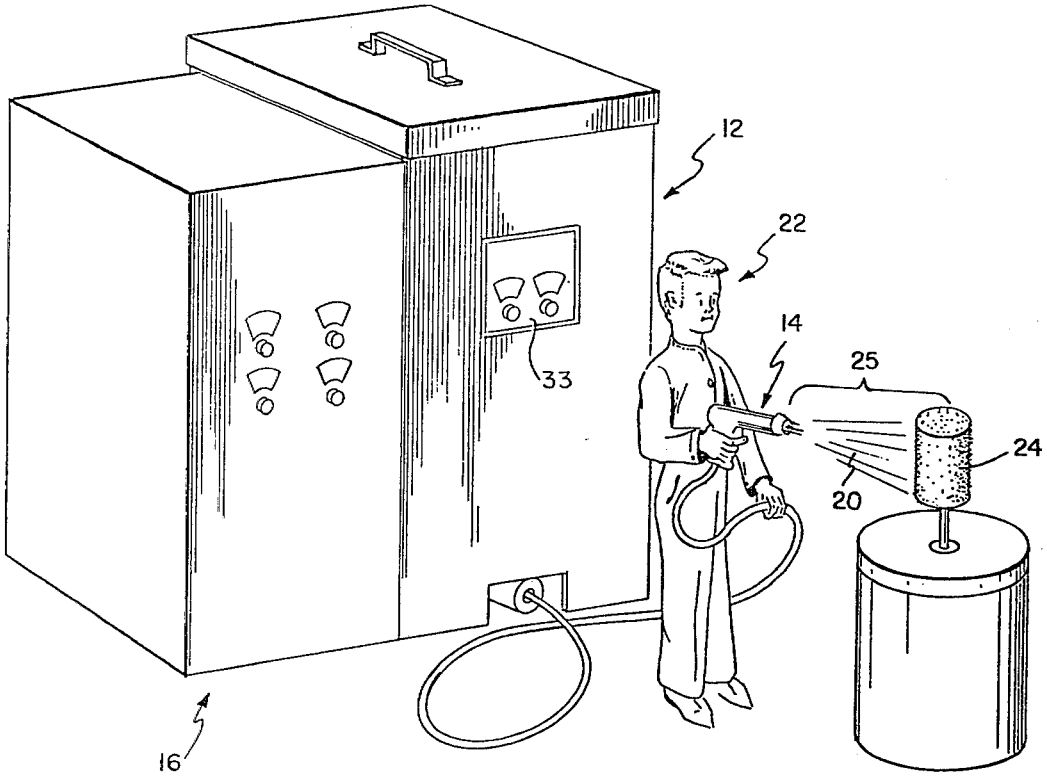
FIG. 1 is an elevation view generally illustrating apparatus that can be employed for carrying out the electrostatic flocking method of this invention.

My electrostatic flocking method can be carried out in the apparatus illustrated in FIG. 1, in which there is a storage hopper 12 for storing a supply of flock fibers therein and having means for delivering these flock fibers at a controlled rate to an applicator gun 14. The fibers have a resistance value of from about $5\times10^5$ to about $1\times10^{11}$ ohms, and the gun 14 is supplied with electrical power from a D.C. high voltage power supply 16 for electrostatically charging said fibers as they exit the gun. The gun is hand held by an operator 22 who directs the spary of flock fibers toward the surface of an article 24 being flocked. The article 24, which is pre-coated with an adhesive film, is electrically grounded (not shown) and an electrostatic field 25 extends between the gun and article so that the positively charged flock fibers 20 are attracted to the article and are fixedly bonded thereto. Conveniently, the electrostatic field forces tend to draw the charged fibers to all sides of the grounded article 24 for coating thereof.

Figure 2:
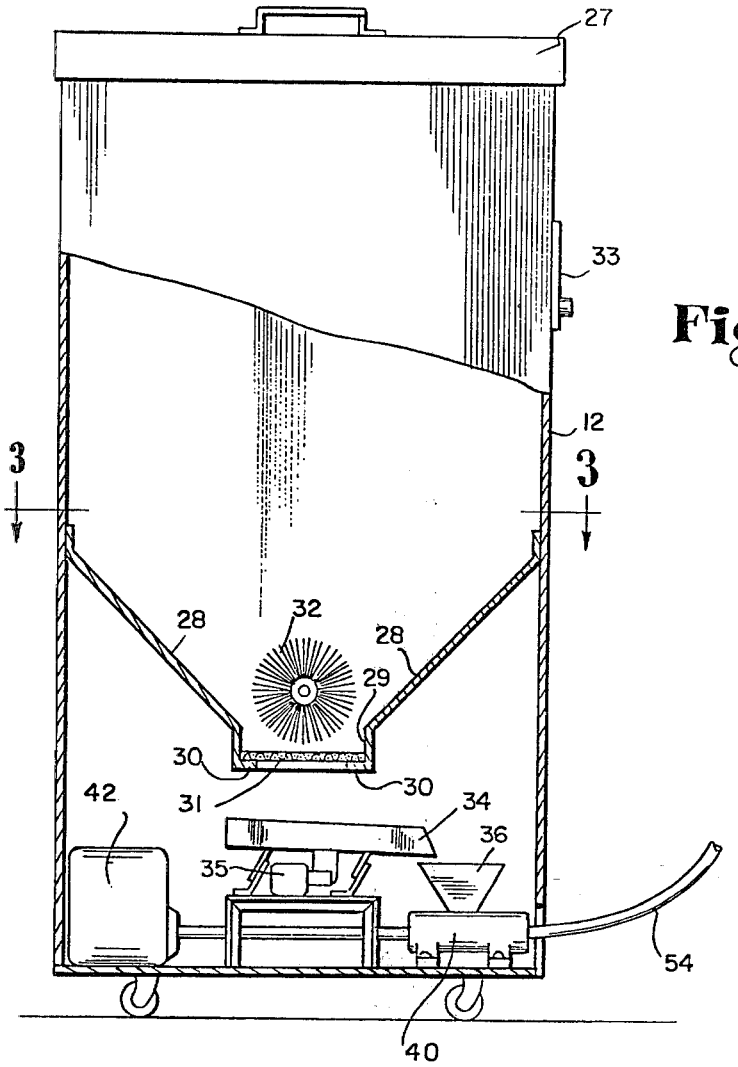
FIG. 2 is an enlarged elevation view showing apparatus for supplying flock fibers to an applicator gun, with portions thereof broken away.
Figure 3:
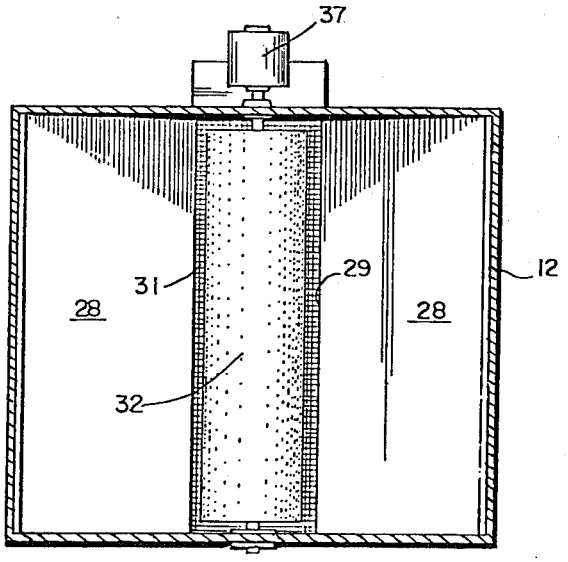
FIG. 3 is an enlarged horizontal section taken on the line 3—3 of FIG. 2.

The hopper 12, shown in detail in FIGS. 2 and 3, is conveniently covered with a removable lid 27 to permit the refilling thereof. The bottom of said hopper is defined by a pair of inwardly angled walls 28 whose lower ends are disposed in spaced relation to each other and form a fiber discharge opening 29. The walls 28 at opening 29 are each bent inwardly to form a pair of horizontally disposed flanges 30 upon which is removably carried a screen 31. The fibers are urged through screen 31 by a brush 32 extending across opening 29 immediately above said screen and driven by a motor 37 electrically connected to a control panel 33 mounted on the outside of the hopper. Said panel 33 is connected to a suitable power source not shown.

The fibers fall through the screen 31 by gravity onto an elongated trough 34. A vibrator 35 is mounted on the trough 34 and is interconnected through the brush motor 37 to the control panel 33 whereby actuation of the brush 32 will simultaneously cause an actuation of the vibrator 35. The trough 34 is angled slightly downwardly for feeding the fibers therefrom into a collecting throat 36. Because of the vibratory action imparted to the fibers as they move along the trough, a substantial portion of said fibers will align themselves longitudinally as they move along said trough and fall into the throat 36.

The throat 36 continuously feeds the fibers into the mouth of a venturi flow tube 40. The venturi tube 40 is supplied with a stream of compressed air from an air pump 42, said pump being supplied with power via the control panel 33. The venturi tube 40 entrains the fibers in a propelling air stream and said fibers are carried in said air stream through an air hose 54 to the applicator gun 14.

The mesh of screen 31, rotational speed of the brush 32, and flow rate through the venturi tube 40 are all a function of the type, length, and denier of the particular flock fibers being used. The fibers can have lengths of from about 0.010 inches to about 0.250 inches and weights of from about 1.5 to about 30 denier. With the fiber characteristics falling within these parameters, the screen may have mesh sizes of from about 8 to about 50. Also, with these parameters, the brush 32 can be disposed above screen 31 at distances from about 0.25 inches to a position in direct contact with said screen and be rotated at speeds of from about 5 to about 150 revolutions per minute. Also, with the fibers falling within these parameters, the air stream moving through the venturi tube 40 can have a flow rate of from about 2 to about 10 cubic feet per minute through the small orifice of the venturi, although additional air is entrained by aspiration. With this flow rate, from about 1 to about 10 ounces per minute of flock fibers can be moved through a hose 54 having a diameter of $\frac{5}{8}$ inch. The air stream, and thus the fibers entrained therein, has a velocity of from about 2,000 to about 5,000 feet per minute, as a computed value ignoring the additional air. While higher velocities may be employed, generally computed velocities higher than 5,000 feet per minute tend to cause an excessively high percentage of the fibers to be blown past the surface to be coated without being deposited thereon, and can cause fibers bound in the adhesive film on the surface to be blown over into a disoriented pattern.

Figure 4:
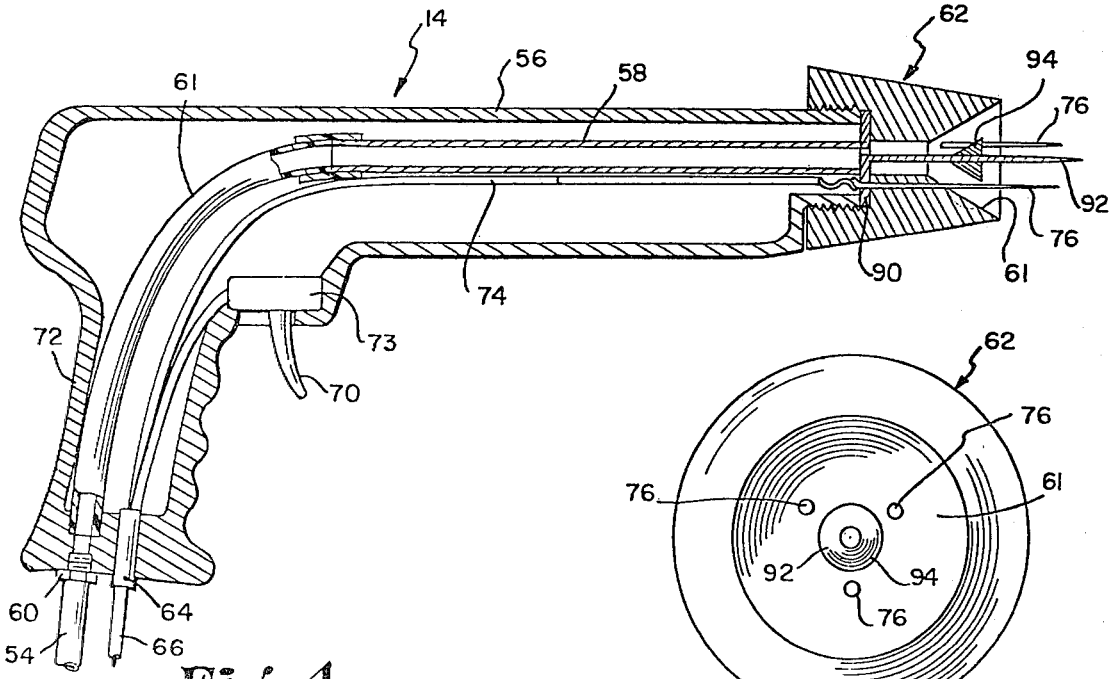
FIG. 4 is an enlarged sectional view of the applicator gun of FIG. 1.
Figure 5:
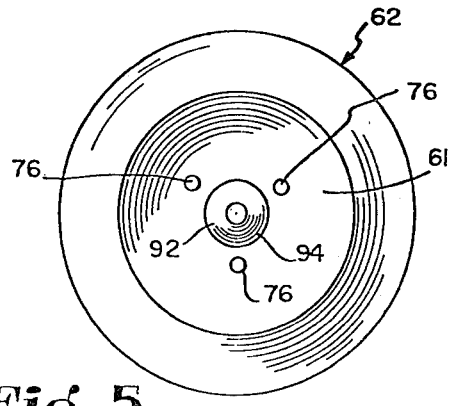
FIG. 5 is an enlarged front view of the applicator gun shown in FIG. 4.

While various types of applicator guns can be employed in carrying out my process, the embodiment of the gun 14 as shown generally diagrammatically in FIGS. 4 and 5 comprises a generally cylindrical barrel 56 having a downwardly projecting handle 72. A longitudinal passage 58 of circular cross-section extends through the barrel forwardly of the handle 72 and terminates at the front end of the barrel in a discharge nozzle 62. The air hose 54 carrying the air-propelled flock fibers 20 is connected by a fitting 60 at the bottom of the handle with a sleeve 61 interconnecting said fitting and the barrel passage 58. In this manner, the flock fibers 20 are carried by their propelling air stream into and completely through the applicator gun 14 and are discharged therefrom through the nozzle 62 at the front end thereof.

A second fitting 64 is mounted on the bottom of handle 72 for connecting an electrical conductor 66 thereto. Said conductor interconnects the applicator gun to the high voltage power supply 16, shown in FIG. 1. The conductor 66 is electrically connected through the gun 14 to a finger-operable low voltage trigger switch 70 mounted in front of the handle 72. The trigger switch 70 is manually operable by the operator 22 to actuate a relay 73 to complete the electrical path to activate the high voltage power supply. The high voltage is supplied from the conductor fitting 64 through a large resistance current limiting resistor 74 to three charging electrodes 76 carried on an inwardly inclined face 61 of the gun nozzle 62. These electrodes, as shown in FIG. 5, are equiangularly spaced about the barrel passage 58 and extend parallel thereto before terminating at the forwardmost extent of the nozzle 62 in the path of the fibers being discharged from the gun. When coupled to the power supply 16, the electrodes are charged with a voltage of from about 10 kilovolts to about 150 kilovolts to electrostatically induce a charge on the flock fibers 20 as they exit the applicator gun 14 and to create the electrostatic field 25 between the gun nozzle 62 and the grounded article 24 being flocked.

As will be understood, the gun components in contact with the high voltage components are made of electrically insulating material to protect the operator 22. It is also understood that the gun can be fixedly or reciprocatingly mounted in fixtures and mechanically actuated thereby eliminating the necessity of the operator holding the gun. This arrangement is particularly advantageous when it is not necessary to manually manipulate the gun to coat remote or recessed areas of the object being coated.

In the flock coating of certain articles, for instance, the interior walls of cylindrically shaped articles, it is desirable to spread the spray pattern of the flock radially outwardly. To accomplish this, I mount a spider 90 in the nozzle 62 to support a small diameter post 92 as shown in FIG. 4. The post 92 projects axially outwardly from the spider, and a diffuser 94, a cone in the embodiment illustrated, is removably and slidably carried on said post. When the diffuser 94 is placed on post 92, it will be disposed directly in the center of the air stream propelling the fibers outwardly from the nozzle. Said diffuser will cause the spray pattern of the fibers in the air stream to flare outwardly from the discharge end of said nozzle. As will be understood, the closer the diffuser 94 is moved inwardly on post 92 toward the spider 90, the more spreading effect said diffuser will have upon the spray pattern being discharged from the gun.

The diffuser and its mounting assembly are merely employed to help control the configuration of the spray pattern and not to impart any electrical properties to the flock fibers. Consequently, these components are all formed from an electrically non-conductive material.

In carrying out my process, the fibers are fed from the hopper 12 into the trough 34 where a substantial portion of said fibers are longitudinally aligned and from which they enter the venturi 40. The propelling air stream then carries them to and through the gun 14 where they are electrostatically charged. Said air stream further aligns the fibers so that they are discharged from the gun in an aligned relationship.

The mechanism by which the air stream aligns the fibers is as follows: A parabolic velocity distribution is created in the air stream whereby the air reaches a maximum velocity in the center of the tube and a low velocity, approaching zero, at the tube wall. This velocity distribution is neither a laminar flow nor a turbulent flow but a rotationally stabilized flow. The rotational energy provides the energy required to maintain the boundary layer attachment and prevent turbulence. The coil in the hose shown in FIG. 1 provides angular momentum and causes the rotation of the air stream in the tube. Other means for generating the air rotation may also be used. The rotational flow, having the appearance of a spiral or rifling effect, may be observed when the tube 54 is of a clear plastic material. The parabolic air velocity distribution causes alignment of the fibers along the tube. If a fiber is not aligned, it must lie in regions of differing velocities. The region of higher velocity tends to pull its end of the fiber ahead of the end which is in the lower velocity region. This consequent rotation is always in the direction to cause fiber alignment along the tube. The tubing is of a sufficiently small diameter to maintain a parabolic velocity distribution of the air stream within the tube, thus avoiding a region of constant velocity in the center of the tube which would result in a non-aligning flow and turbulence.

The charged fibers are blown from the gun through the electrostatic field 25 by the propelling air stream and are deposited on the film of adhesive on the article 24. The air stream imparts a sufficient velocity to the fibers 20 that those fibers that are not bound in the adhesive film are blown past the article 24 and are captured for subsequent use or are rebounded back into the electrostatic field 25 and then reattached to the article where they can be captured and bound by the adhesive film. This prevents the fibers that are not bound in the adhesive film from being physically entangled in the fibers that are adhesively bound and thereby eliminates high density fiber areas which will slough off.

In a specific example of carrying out my process for electrostatically coating automobile sun visors with a flock coating, the visors were coated with an adhesive film and coated with nylon fibers having a length of 0.040 inches, a weight of 3 denier, and a resistance of $1\times10^6$ ohms. These fibers were fed through the screen 31 which was a 12 mesh screen while the brush 32 was rotating in contact with said screen at 47 revolutions per minute. The fibers were fed to the venturi at the rate of $3\frac{1}{3}$ ounces per minute, while the propelling air fed to said venturi had a flow rate of 3 cubic feet per minute. The fibers were discharged from the gun 14 while its electrodes were maintained at a voltage of 80 kilovolts. Under these operating conditions, a highly uniform and dense flock coating was deposited on the visors.

I claim:

1. Apparatus for electrostatically depositing elongated fibers comprising means for feeding said fibers and means for generally aligning and delivering said fibers in a rotationally statilized flow, said aligning and delivery means including a venturi flow tube for receiving said fibers, a source of compressed air to said venturi flow tube to entrain said fibers, and an elongated non-rectilinear small diameter tube connected between said venturi flow tube and an electrostatic gun for delivering said fibers and maintaining their alignment in a parabolic air velocity distribution within the tube, said electrostatic gun including a nozzle and an electrode that is connected to a source of high voltage, said tube being connected with said gun nozzle.

2. Apparatus for depositing elongated fibers comprising means for feeding said fibers, a delivery gun, and means for generally aligning and delivering said fibers from said feeding means to and through said gun, said delivery means including an elongated non-rectilinear tube connecting said feeding means and said gun, means for delivering a high velocity stream of compressed air through said tube with said fibers entrained therein, said tube being of sufficiently small diameter to maintain a parabolic velocity distribution of the air stream within the entire length of the tube.

3. Apparatus as set forth in claim 2 wherein said gun has electrode means for creating an electrostatic field, and the high velocity air stream and the entrained flock fibers are diffused as they enter the electrostatic field and are aligned, charged, and generally directed along the lines of force of the electrostatic field.

4. Apparatus for depositing elongated fibers comprising means for feeding said fibers, a delivery gun, means for generally aligning and delivering said fibers from said feeding means to and through said gun, said delivery means including a venturi flow tube for receiving said aligned fibers, means for supplying compressed air to said venturi flow tube in a high velocity stream to entrain said fibers, and an elongated non-rectilinear tube connecting said venturi flow tube to said gun, said tube being of sufficiently small diameter to maintain a parabolic velocity distribution of the air stream within the entire length of the tube.

5. An apparatus for depositing elongated fibers, comprising means to align the longitudinal axes of the fibers and maintain their longitudinal axes generally aligned with their path of travel during delivery from a source and electrostatic charging and deposition on an article surface, said means including means to align the fibers and present the aligned fibers to a venturi, means to deliver a high-velocity flow of compressed air to the venturi and to entrain aligned fibers in the flow of compressed air through the venturi, means forming a non-rectilinear passageway of sufficiently small diameter to maintain a parabolic air velocity distribution within the entire length of the passageway delivering said fibers, an electrostatic gun including a nozzle and an electrode, and means to create an electrostatic field between the gun electrode and the article surface to be coated, said fibers being directed from the nozzle of the gun into the electrostatic field generally along the lines of force of the electrostatic field.

* * * * *